US006442355B2

(12) United States Patent
Hasegawa et al.

(10) Patent No.: US 6,442,355 B2
(45) **Date of Patent: *Aug. 27, 2002**

(54) DEVELOPER DENSITY CONTROLLING APPARATUS INCLUDING TARGET DENSITY INFORMATION DETECTION AND TONER IMAGE DENSITY DETECTION

(75) Inventors: Kazuhiro Hasegawa, Numazu; Shigeo Kimura, Mishima; Koji Masuda; Akihiko Sato, both of Numazu; Takao Ogata, Susono; Fumitake Hirobe, Odawara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 16 days.

(21) Appl. No.: 09/511,245

(22) Filed: Feb. 23, 2000

(30) Foreign Application Priority Data

Feb. 24, 1999 (JP) ..... 11-046637
Mar. 4, 1999 (JP) ..... 11-056869

(51) Int. Cl.[7] ..... G03G 15/08
(52) U.S. Cl. ..... 399/58; 399/60; 399/62
(58) Field of Search ..... 399/49, 58, 60, 399/61, 62, 59

(56) References Cited

U.S. PATENT DOCUMENTS 5,038,175 A * 8/1991 Sohmiya et al. ..... 399/58

FOREIGN PATENT DOCUMENTS

JP 9-127757 5/1997
JP 10-333420 * 12/1998

* cited by examiner

*Primary Examiner*—Joan Pendegrass
(74) *Attorney, Agent, or Firm*—Fitzpatrick, Cella, Harper & Scinto

(57) ABSTRACT

A developer density controlling apparatus includes image density detecting device for detecting a target density on the basis of a detected image and, if a difference between a toner density detected by a developer density detecting device and the target density is equal to or greater than a predetermined value, the image density detecting device does not correct the target density.

27 Claims, 13 Drawing Sheets

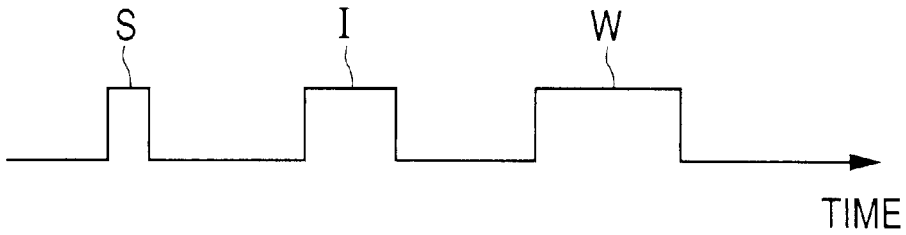
FIG. 3A LASER DRIVING PULSE
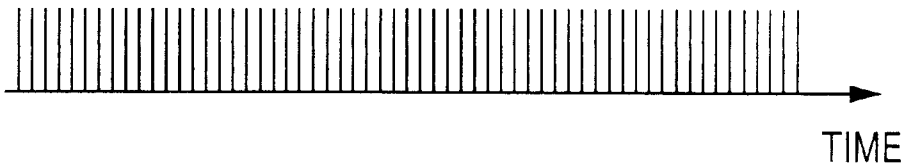
FIG. 3B CLOCK PULSE
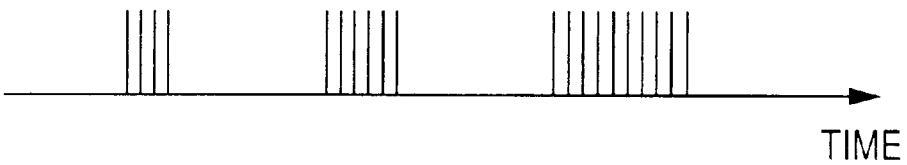
FIG. 3C NUMBER OF CLOCK PULSE
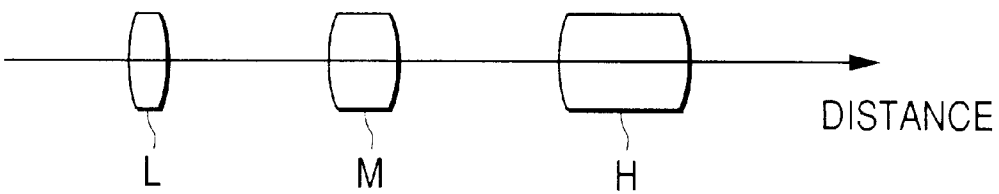
FIG. 3D ELECTROSTATIC LATENT IMAGE

DEVELOPER DENSITY CONTROLLING APPARATUS INCLUDING TARGET DENSITY INFORMATION DETECTION AND TONER IMAGE DENSITY DETECTION

BACKGROUND OF THE INVENTION

1. Field of the Invention

The present invention relates to an image forming apparatus of electrophotographic type or electrostatic recording type embodied as a copying machine, a printer and the like, and a developer density controlling apparatus used with such an image forming apparatus, and more particularly it relates to an image forming apparatus having a density controlling apparatus for controlling toner density or image density of the developer developing agent through toner replenishing control of two-component developer.

2. Related Background Art

In general, in developing devices of an image forming apparatuses of electrophotographic type or electrostatic recording type, one-component developer mainly including magnetic or non-magnetic toner, or two-component developer mainly including non-magnetic toner and magnetic carrier is used. Particularly, in color image forming apparatuses for forming a full-color or multi-color image by an electrophotographic system, many developing devices utilize two-component developer in consideration of color tone and image quality of an image.

As is well-known, toner density (ratio of a weight of toner with respect to a total weight of carrier and toner) of the two-component developer is a very important factor for stabilizing image quality. During development, the toner in the developer is gradually consumed to reduce the toner density. Thus, it is required that the toner density or image density is always detected by using a toner density controlling apparatus (toner density detecting means) or image density detecting means and toner is replenished in accordance with the change in density to keep the toner density or image density constant, thereby maintaining the image quality.

FIG. 7 shows an example of an image forming apparatus (digital copying machine of electrophotographic type in this example) having a conventional toner density controlling apparatus.

First of all, an image on an original G is read by a CCD 1, and a read analogue image signal is amplified to a predetermined level by an amplifier 2 and then is converted into an 8-bit (0 to 255 gradations) digital image signal by an analogue/digital converter (AID converter) 3, for example.

Then, the digital image signal is sent to a γ-converter 5 (converter for effecting density conversion by a look-up table system constituted by a 256-byte RAM, in this example), where the signal is subjected to γ-correction. Thereafter, the signal is inputted to a digital/analogue converter (D/A converter) 9.

The digital image signal is converted into an analogue image signal again by the converter 9 and then is inputted to one of inputs of a comparator 11. A triangular wave signal having predetermined period generated from a triangular wave generating circuit 10 is inputted to the other input of the comparator 11, so that the analogue image signal supplied to the one input of the comparator 11 is compared with the triangular wave signal and is subjected to pulse width modulation. The pulse width modulated binary image signal is inputted to a laser driving circuit as it is, and is used as an ON/OFF control signal for light emission of a laser diode 13.

A laser beam emitted from the laser diode 13 is scanned by a known polygon mirror 14 in a main scanning direction and is illuminated onto a photosensitive drum 40 as an image bearing member (rotated in a direction shown by the arrow) through an fθ lens 15 and a reflection mirror 16, thereby forming an electrostatic latent image.

On the other hand, the photosensitive drum 40 is subjected to uniform electricity removal by an exposure device 18 and then is uniformly charged, for example negatively, by a primary charger 19. Thereafter, the laser beam is illuminated onto the photosensitive drum, thereby forming the electrostatic latent image corresponding to an image signal. The electrostatic latent image is developed by a developing device 20 as a visualized image (toner image). A toner replenishing hopper (tank) 8 containing replenishing toner 29 is attached to an upper part of the developing device 20, and a toner carrying screw (toner replenishing means) 30 rotated by a motor to carry the toner 29 and supply it into the developing device 20 is disposed at a lower part of the hopper 8.

The toner image formed on the photosensitive drum 40 is transferred, by a transfer charger 22, onto a transfer material P conveyed to the photosensitive drum 40 by a transfer material bearing belt 17. The transfer material bearing belt 17 is mounted and extending between two rollers 25*a* and 25*b* and is driven in a direction shown by the arrow in an endless fashion; meanwhile, the transfer material P borne on the belt is conveyed to the photosensitive drum 40. Residual toner remaining on the photosensitive drum 40 is scraped by a cleaner 24.

Incidentally, for simplifying the explanation, although only a single image forming station (comprised of latent image forming means including the exposure device 18 and the primary charger 19, the photosensitive drum 40, the developing device 20 and the like) is shown, in case of a color image forming apparatus, image forming stations corresponding to various colors (for example, cyan, magenta, yellow and black) are arranged in series above the transfer material bearing belt 17 along the shifting direction thereof.

The image forming apparatus is designed so that, in order to keep the toner density of developer or image density constant by effecting control for replenishing the toner to the developer 21 (toner density thereof is decreased) within the developing device 20, by controlling rotation of a motor 28 by a CPU 6 through a motor driving circuit 7 on the basis of an output value a toner density sensor 23 provided within the developing device 20, the control for replenishing the toner to the developer 21 within the developing device 20, thereby keeping the toner density of developer or image density constant. Control data supplied to the motor driving circuit 7 is stored in a RAM 90 connected to the CPU 6.

In order to control the toner density of developer or image density to be kept constant by effecting control for replenishing the toner to the developer 21 (toner density thereof is decreased) within the developing device 20, one of density controlling apparatuses (ATR) of various types is provided within the image forming apparatus.

More specifically, regarding the toner density sensor 23 provided within the developing device 20, an auto-toner replacement (ATR) control system (developer reflection ATR) in which the toner density of the developer 21 within the developing device 20 is detected as a reflected light amount, a control system (inductance ATR) in which permeability of magnetic carrier of the developer 21 within the developing device 20 is detected, or a control system (patch detection ATR) in which a reference patch image 26 is formed on the photosensitive drum 40 and image density of the patch image is detected by a sensor 27 such as a potential sensor opposed to the photosensitive drum 40 can be used.

However, since each of the above-mentioned ATRs by itself detects only the image density or toner density, countermeasure to change in environment or change in developing ability due to degradation of developer cannot be effected, so that the image may be deteriorated. Thus, a technique in which two or more ATRs are combined to compensate for the respective defects thereby to permit toner replenishing control has been proposed, as disclosed in Japanese Patent Application Laid-Open No. 9-127757.

According to this patent document, the toner is replenished by the developer reflection ATR, and, in this case, a toner excess/deficiency amount required for returning patch image density to initial density is calculated from output signals representative of difference in density of the patch image, and the toner replenishing amount is corrected by adding or subtracting the calculated result with respect to a target value set in the developer reflection ATR so that the toner replenishing control of the developer reflection ATR is effected by using the corrected toner replenishing amount, thereby preventing overflow and/or fog of the developer, while stabilizing the image density.

However, the above-mentioned combined density controlling apparatus has the following disadvantages.

For example, if the toner density in developer becomes greater than the target value of the developer reflection ATR due to a reading error of the developer reflection ATR and/or dispersion in toner replenishing amount of the toner replenishing hopper, the patch detection ATR will judge that the image density is high and decrease the target value of the developer reflection ATR excessively. Consequently, even when the image density becomes proper by the toner consumption during the copying operation, since the target value of the developer reflection ATR is decreased, the toner is not replenished until the toner is further consumed to decrease the image density. That is to say, if the image density is once deviated greatly for any reason, the change in image density will continue for a long term.

Further, in such a condition, if images which consume less toner continue to be copied, since the excessive toner cannot be consumed, the target value of the developer reflection ATR is abruptly decreased so that the difference between the toner density during the development and the target value becomes great, with the result that the control becomes impossible, or, in a system having control for detecting malfunction and/or erroneous detection of the respective ATR sensors, abnormality of the ATR sensor may be detected notwithstanding the ATR sensors are operated correctly.

SUMMARY OF THE INVENTION

An object of the present invention is to provide a developer density controlling apparatus and an image forming apparatus, in which image density can be controlled stably.

Another object of the present invention is to provide a developer density controlling apparatus and an image forming apparatus, in which, even if toner density in developing means is greatly deviated from a target value, image density can be controlled stably to obtain high quality images from initiation of image formation.

A further object of the present invention is to provide a developer density controlling apparatus comprising developer density detecting means for detecting toner density in developer, toner replenishing means for replenishing toner on the basis of difference between the toner density detected by the developer density detecting means and target density, and image density detecting means for detecting image density of a reference image formed and for correcting the target density on the basis of the detected image density, wherein, if the difference between the toner density detected by the developer density detecting means and the target density is equal to or greater than a predetermined value, the image density detecting means do not correct the target density.

A still further object of the present invention is to provide an image forming apparatus comprising an image bearing member for bearing a latent image; and a developer density controlling apparatus including developer density detecting means for detecting toner density in developer, toner replenishing means for replenishing toner on the basis of difference between the toner density detected by the developer density detecting means and target density, and image density detecting means for detecting image density of a reference image formed and for correcting the target density on the basis of the detected image density, wherein, if the difference between the toner density detected by the developer density detecting means and the target density is equal to or greater than a predetermined value, the image density detecting means do not correct the target density.

The other objects and features of the present invention will be apparent from the following detailed explanation referring to the accompanying drawings.

BRIEF DESCRIPTION OF THE DRAWINGS

FIGS. 3A, 3B, 3C and 3D are explanatory views image forming information signals in the image forming apparatus of FIG. 1;

DESCRIPTION OF THE PREFERRED EMBODIMENT

Now, a first embodiment of the present invention will be explained with reference to FIGS. 1 to 6.

First of all, the entire construction of an image forming apparatus according to the first embodiment of the present invention will be described with reference to FIG. 1. In this embodiment, while an example that the present invention is applied to a digital copying machine of electrophotographic type will be explained, it should be noted that the present invention can be equally applied to many other image forming apparatuses of electrophotographic type or electrostatic recording type.

Figure 1:
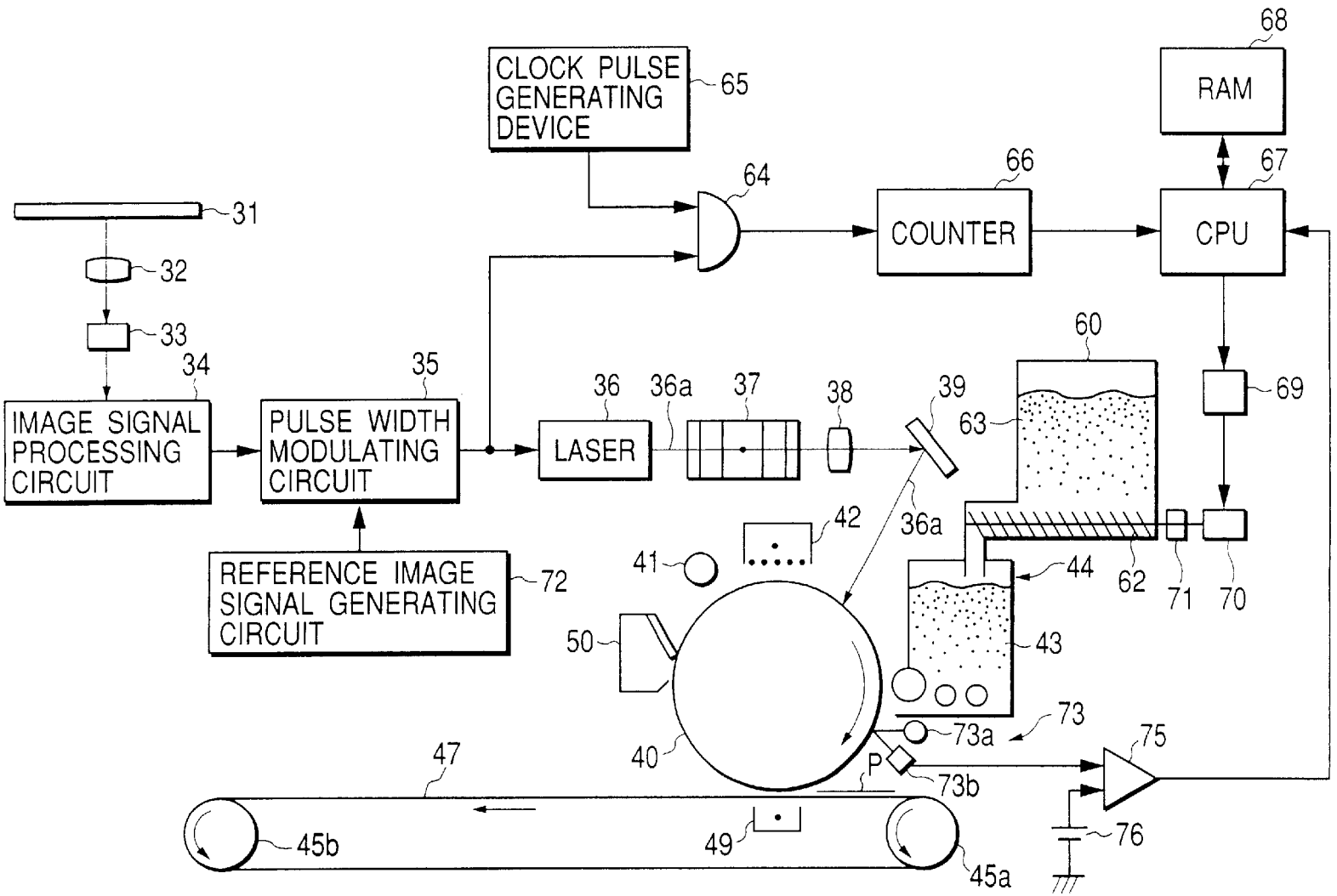
FIG. 1 is a constructural view of an image forming apparatus according to an embodiment of the present invention.

In FIG. 1, an image on an original 31 to be copied is projected onto an imaging element 33 such as CCD through a lens 32. The imaging element 33 decomposes an original image into the number of pixels and generates photoelectric conversion signals corresponding to densities of the pixels. The analogue image signals outputted from the imaging element 33 are sent to an image signal processing circuit 34, where the signals are conveyed into pixel image signals having output levels corresponding to the densities of the pixels and then are sent to a pulse width modulating circuit 35.

Whenever the pixel image signal is inputted to the pulse width modulating circuit 35, the pulse width modulating circuit 35 forms and outputs a laser drive pulse having a width (time length) corresponding to the level of the signal. That is to say, as shown in FIG. 3A, regarding the pixel image signal having high density, a drive pulse W having wide width is formed, and, regarding the pixel image signal having low density, a drive pulse S having narrow width is formed, and, regarding the pixel image signal having intermediate density, a drive pulse I having intermediate width is formed.

The laser drive pulse outputted from the pulse width modulating circuit 35 is supplied to a semiconductor laser 36, thereby lighting the semiconductor laser 36 for a time corresponding to the pulse width. Accordingly, the semiconductor laser 36 is driven for longer time regarding the high density pixel and for shorter time regarding the low density pixel. Therefore, a greater area on a photosensitive drum 40 in a main scanning direction is exposed regarding the high density pixel and a smaller area in a main scanning direction is exposed regarding the low density pixel by the following optical system. That is to say, the dot size of the electrostatic latent image is varied in accordance with the image density. Accordingly, of course, the toner consuming amount in the high density image is greater than that in the low density image. Incidentally, electrostatic latent images for low, intermediate and high density images are shown in FIG. 3D as L, M and H, respectively.

The laser beam 36*a* emitted from the semiconductor laser 36 is swept by a rotating polygon mirror 37 and is focusing on the photosensitive drum (image bearing member) 40 as a spot through a lens 38 such as an fθ lens and a fixed mirror 39 for directing the laser beam 36*a* toward the photosensitive drum 40. In this way, the laser beam 36*a* scans the photosensitive drum 40 in a direction (main scanning direction) substantially parallel to an rotational axis thereof, thereby forming the electrostatic latent image.

The photosensitive drum 40 is an electrophotographic photosensitive member having a surface made of photosensitive material such as amorphous silicone, selenium, OPC or the like and rotated in a direction shown by the arrow. After electricity on the photosensitive drum is uniformly removed by an exposure device 41, the photosensitive drum is uniformly charged by a primary charger 42. Thereafter, the drum is subjected to exposure scanning by the laser beam 36*a* modulated in correspondence to the image information signal, thereby forming the electrostatic latent image corresponding to the image information. The electrostatic latent image is subjected to reversal developing by a developing device (developing means) 44 using two-component developer 43 including toner and carrier, thereby visualizing the latent image as a toner image. The reversal developing is a developing method in which the latent image is visualized by adhering the toner charged to the same polarity as that of the latent image (area light-exposed on the photosensitive drum 40).

The toner image is transferred, by a transfer charger 49, onto a transfer material P conveyed to the photosensitive drum 40 by a transfer material bearing belt 47. The transfer material bearing belt 47 is mounted and extending between two rollers 45*a* and 45*b* and is driven in a direction shown by the arrow in an endless fashion; meanwhile, the transfer material P borne on the belt is conveyed to the photosensitive drum 40. The transfer material P to which the toner image was transferred is separated from the transfer material bearing belt 47 and then is sent to a developing device (not shown), where the toner image is fixed as a permanent image. Thereafter, residual toner remaining on the photosensitive drum 40 is scraped by a cleaner 50.

Incidentally, for simplifying the explanation, although only a single image forming station (comprised of latent image forming means including the exposure device 41 and the primary charger 42, the photosensitive drum 40, the developing device 44, and the like) is shown, the image forming apparatus according to the illustrated embodiment is a color image forming apparatus having image forming stations corresponding to various colors (for example, cyan, magenta, yellow and black), in which the image forming stations are arranged in series above the transfer material bearing belt 47 along the shifting direction thereof, and the electrostatic latent images for various colors (color components of the image) color-decomposed from the image of the original are successively formed on the photosensitive drums in various image forming stations and are developed by the developing devices containing the respective color toners as various color toner images which are in turn transferred successively, in a superposed fashion, onto the transfer material P conveyed by the transfer material bearing belt 47.

Figure 2:
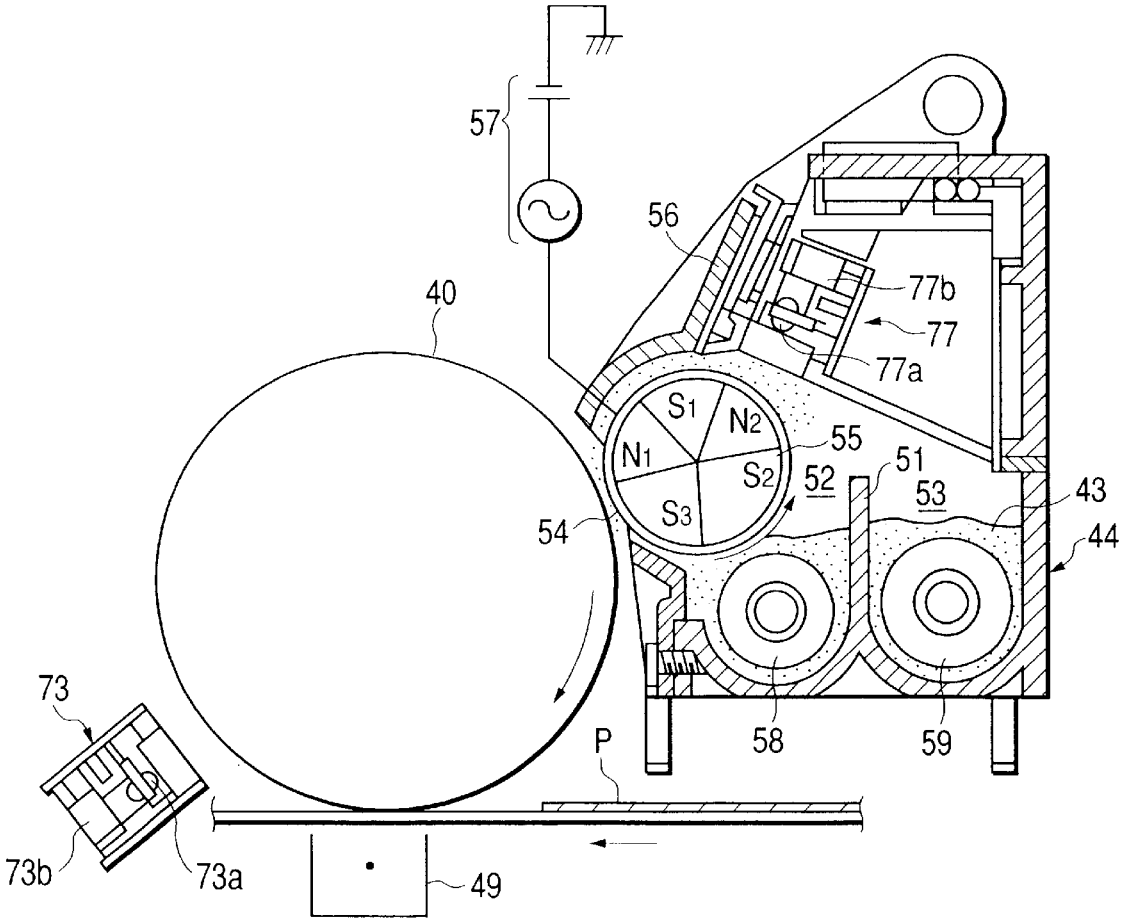
FIG. 2 is a schematic sectional view of a developing apparatus included in the image forming apparatus of FIG. 1.

An example of the developing device 44 is shown in FIG. 2. As shown, the developing device 44 according to the illustrated embodiment is disposed in an opposed relationship to the photosensitive drum 40, and the interior of the developing device is divided into a first chamber (developing chamber) 52 and a second chamber (agitating chamber) 53 by a partition wall 51 extending in a vertical direction. A non-magnetic developing sleeve 54 rotated in a direction shown by the arrow is disposed within the first chamber 52, and a magnet 55 is fixed in the developing sleeve 54.

As shown in FIG. 1, a toner replenishing hopper 60 containing replenishing toner 63 is attached to an upper part of the developing device 44, and a toner carrying screw (toner replenishing means) 62 is disposed at a lower part of the hopper 60. By rotating the toner carrying screw 62 by a motor connected through a gear train 71, the toner in the toner replenishing hopper 60 is supplied to the developing device 44. The supplying of toner by means of the toner carrying screw 62 is controlled by controlling rotation of the motor 70 by a CPU 67 through a motor drive circuit 69. Control data to be supplied to the motor drive circuit 69 is stored in a RAM 68 connected to the CPU 67.

Developer agitating screws 58, 59 are disposed within the first and second chambers 52, 53 of the developing device 44. The screw 58 serves to agitate and carry the toner in the first chamber 52, and the screw 59 serves to agitate and carry the toner 63 supplied from the toner replenishing hopper 60 of FIG. 1 by the rotation of the carrying screw 62 and the toner 43 already contained within the developing device 44, thereby making toner density of the toner 43 uniform. The partition wall 51 is provided at its front and rear (FIG. 2) ends with developer passages (not shown) for communicating the first and second chambers 52, 53 with each other, so that the developer (toner density of which decreased by consumption of toner during the developing) in the first chamber 52 is shifted to the second chamber 53 through one of the passages and the developer (toner density of which is restored) within the second chamber 53 is shifted to the first chamber 52 through the other passage, by the carrying forces of the screws 58, 59.

The two-component developer 43 within the developing device 44 is borne on the developing sleeve 54 by a magnetic force of the magnet 55 and a thickness of the developer on the developing sleeve is regulated by a blade 56. The developer layer on the developing sleeve is carried to a developing area opposed to the photosensitive drum 40 as the developing sleeve 54 is rotated. In order to enhance developing efficiency, i.e., ratio for supplying the toner to the latent image, developing bias voltage obtained by overlapping AC bias with DC bias is applied to the developing sleeve 54 from a power supply 57.

Next, control of a density controlling apparatus which is one of characteristics of the present invention will be explained.

The density controlling apparatus according to the illustrated embodiment comprises image density detecting means (patch detection ATR) in which a reference patch image, i.e., reference image is formed on the photosensitive drum 40 and image density of the patch image is detected by a toner density sensor 73 having a light emitting portion 73*a* opposed to the photosensitive drum 40 and a light receiving portion 73*b*, and developer density detecting means (developer reflection ATR) as toner density detecting means in which toner density of the developer 43 within the developing device 44 is detected by a toner density sensor 77 having a light emitting portion 77*a* and a light receiving portion 77*b* disposed within the developing device 44.

Figure 4:
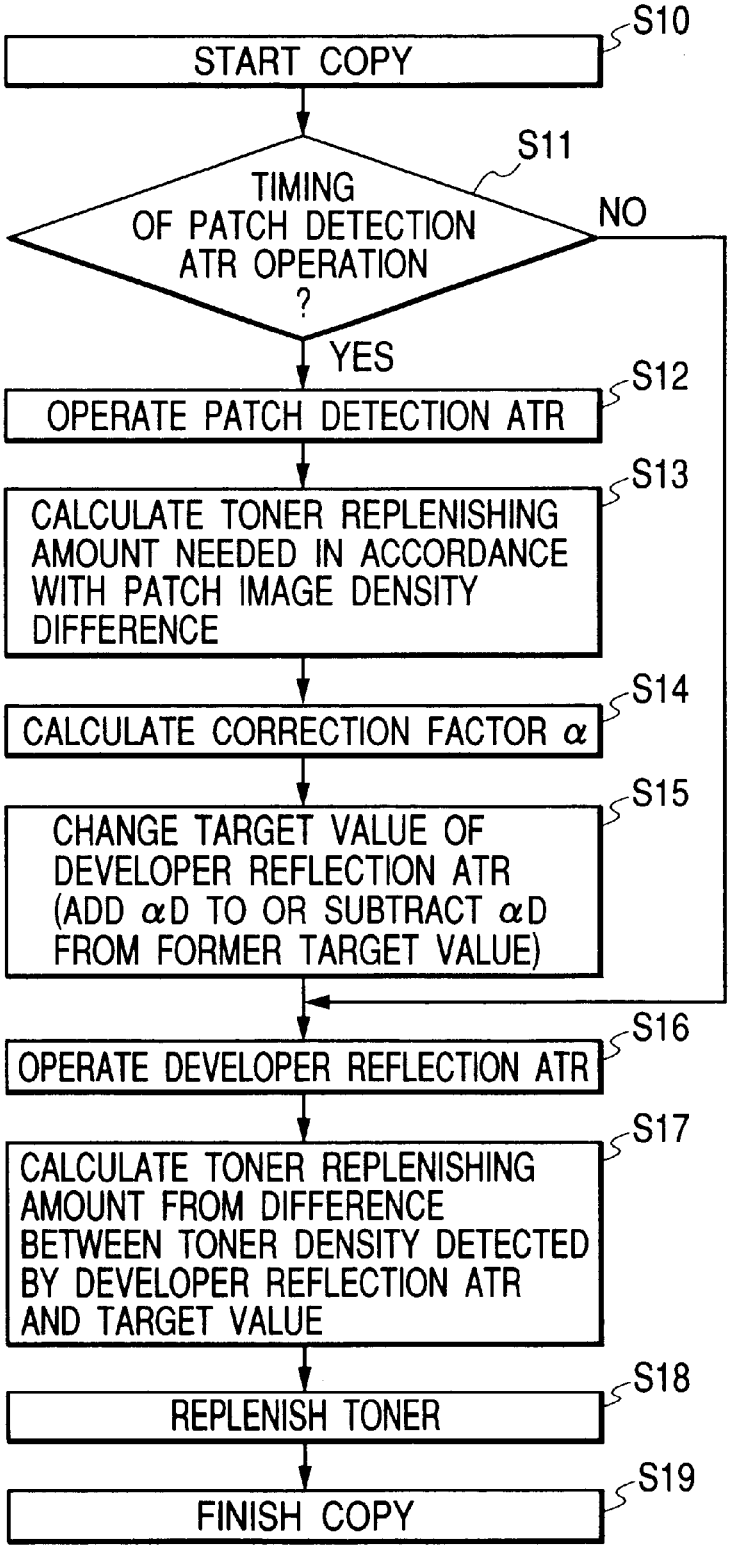
FIG. 4 is a flowchart of toner density control according to a first embodiment.

As shown in FIG. 4, after copy start (step S10), it is judged whether or not a timing of patch detection ATR operation is a predetermined timing (step S11). If the predetermined timing, a patch image as a density detecting reference image is formed on the photosensitive drum 40. That is to say, as shown in FIG. 1, a patch image signal generating circuit 72 for generating a patch image signal having a signal level corresponding to predetermined density is provided, so that the patch image signal from the patch image signal generating circuit 72 is supplied to a pulse width modulating circuit 35, thereby generating a laser driving pulse having a pulse width corresponding to the predetermined density. The laser driving pulse is supplied to a semiconductor laser 36, so that the laser 36 is lighted for a time corresponding to the pulse width, thereby scanning the photosensitive drum 40. In this case, a counter 66 is not operated. As a result, a patch electrostatic latent image corresponding to the predetermined density is formed on the photosensitive drum 40, and the patch electrostatic latent image is developed by the developing device 44.

Then, the patch image (toner image) obtained in this way is illuminated by light from the light emitting portion 73*a* such as an LED of the density sensor 73 of the patch detection ATR, and reflected light is received by the light receiving portion 73*b* such as a photoelectric converting element, thereby detecting the actual patch density of the patch image (step S12).

An output signal representative of the actual patch density from the light receiving portion 73*b* is supplied to one of the inputs of a comparator 75. A reference signal corresponding to normal density (initial density) of the patch image is inputted from a reference voltage signal source 76 to the other input of the comparator 75. The comparator 75 serves to compare the actual density of the patch image with the initial density, to seek a toner replenishing amount D corresponding to image density difference and to supply an output signal representative of the toner replenishing amount D to the CPU 67 (step S13).

Then, (TC2–TC1) which is a difference value between the toner density TC1 in the developer obtained from the developer reflection ATR in the pre-copy operation and a target toner density value TC2, and a correction amount to the present target value corresponding to the toner replenishing amount D obtained from the patch image are determined. Incidentally, more specifically, a value sought from (TC2–TC1) is correction factor $\alpha$ (step S14). Then, the target value is subjected to addition or subtraction by product $\alpha D$ of the correction factor $\alpha$ and the toner replenishing amount D obtained from the patch detection ATR as a correction amount (step S15).

Figure 5:
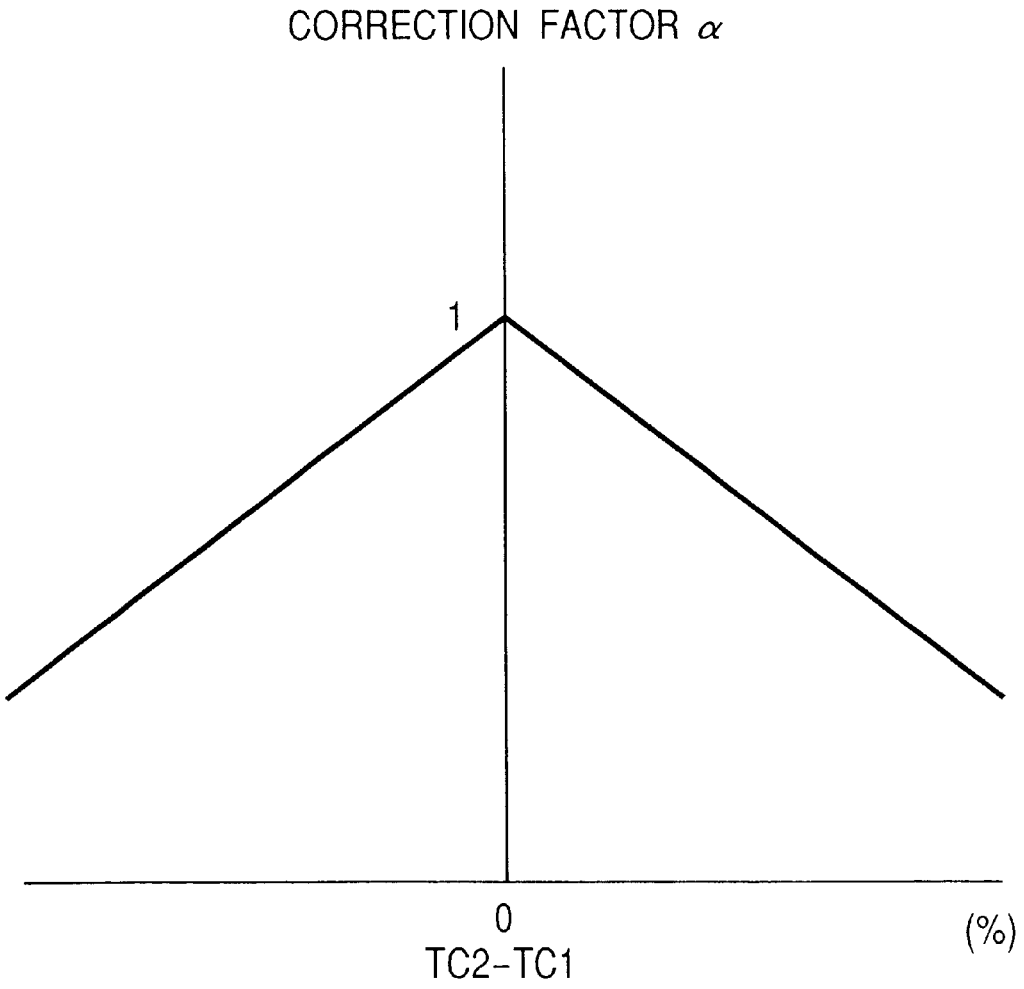
FIG. 5 is a graph showing a relationship TC1–TC2 and correction factor.

In the illustrated embodiment, a relationship between (TC2–TC1) and the correction factor $\alpha$ is as shown in a graph of FIG. 5. Incidentally, in FIG. 5, although the above relationship is linear, a curve or discontinuity may be used in accordance with an image density controlling system. Further, it is not necessary that the relationship is symmetrical around zero (0).

Then, the develop reflection ATR is operated to obtain the toner density of the developer 43 within the developing device 44 (step S16). Finally, the toner replenishing amount is calculated and determined on the basis of the difference value between the corrected target value (previous target value+$\alpha D$ ) and the toner density of the developer 43 obtained by the developer reflection ATR (step S17), and the toner is replenished (step S18), and then the copying operation is ended (step S19).

Incidentally, in the step S11, if it is not the predetermined timing of the patch detection ATR, the previous target value is used, and the similar toner replenishing is effected.

As mentioned above, in the illustrated embodiment, when the toner replenishing control for the two-component developer is effected, since the patch image density difference in the toner replenishing control by the patch detection ATR is sought and the toner replenishing control by the developer reflection ATR is effected, if there are sensor error, error in the toner replenishing hopper and/or fluctuation in toner consumed amount in the consuming system, the toner density of the developer can be controlled to density by which the proper image density of the toner image can be obtained, and a high quality image in which image density of the toner image is controlled properly can be formed.

Next, a more preferred alteration of the first embodiment of the present invention will be described with reference to FIG. 6.

Regarding this alteration, in the toner replenishing control of the first embodiment, if (TC2–TC1) which is the difference value between the toner density TC1 in the developer obtained from the developer reflection ATR in the pre-copy operation and the target toner density TC2 is equal to or greater than a predetermined value (1.5% in this alteration), the correction amount of the target value is made to zero (0), i.e., the target value is not corrected. Further, if (TC2–TC1) is equal to or smaller than the predetermined value, regardless of the value of (TC2–TC1), the target value is changed by using a value obtained by multiplying given factor β (fixed value) (0.4 in this alteration) by the toner replenishing amount obtained from the output value of the patch detection ATR as a correcting amount.

Figure 6:
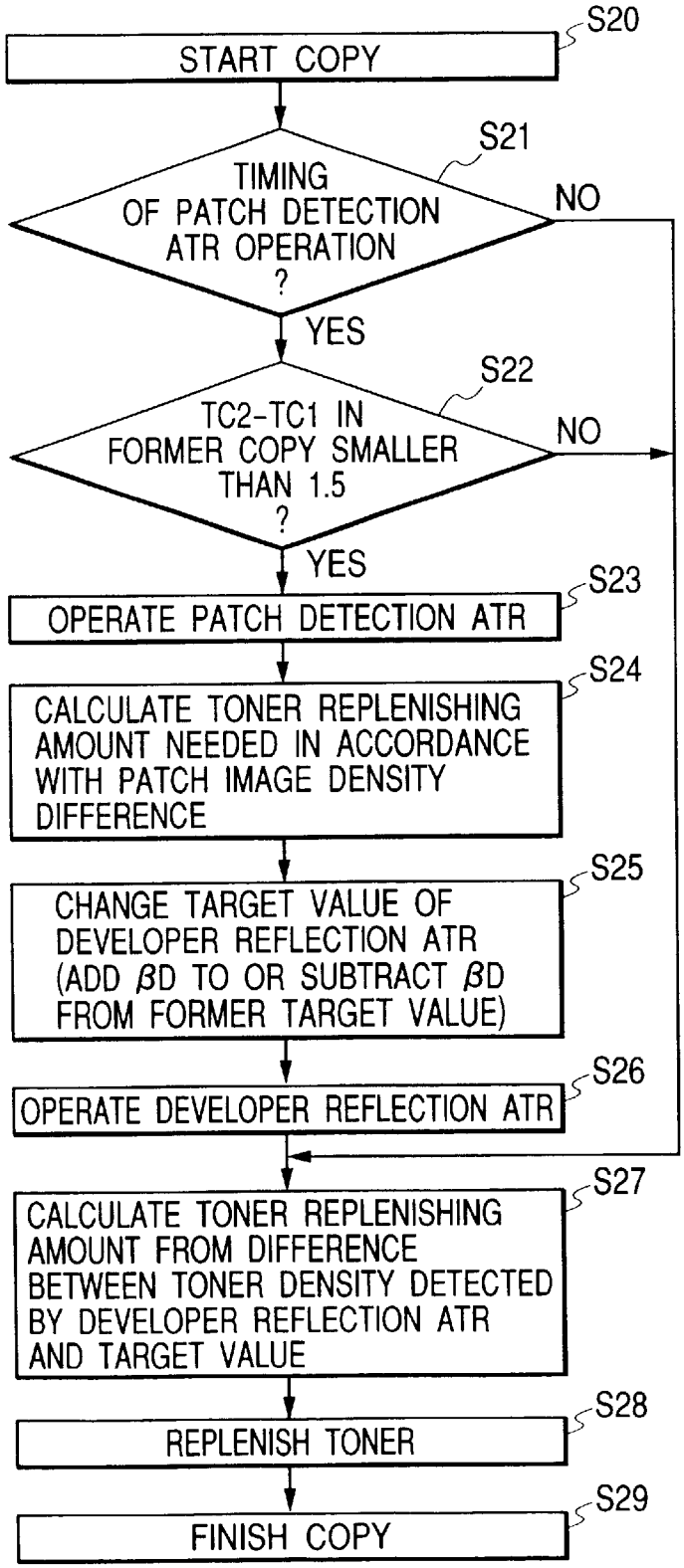
FIG. 6 is a flowchart of toner density control according to a second embodiment.
Figure 7:
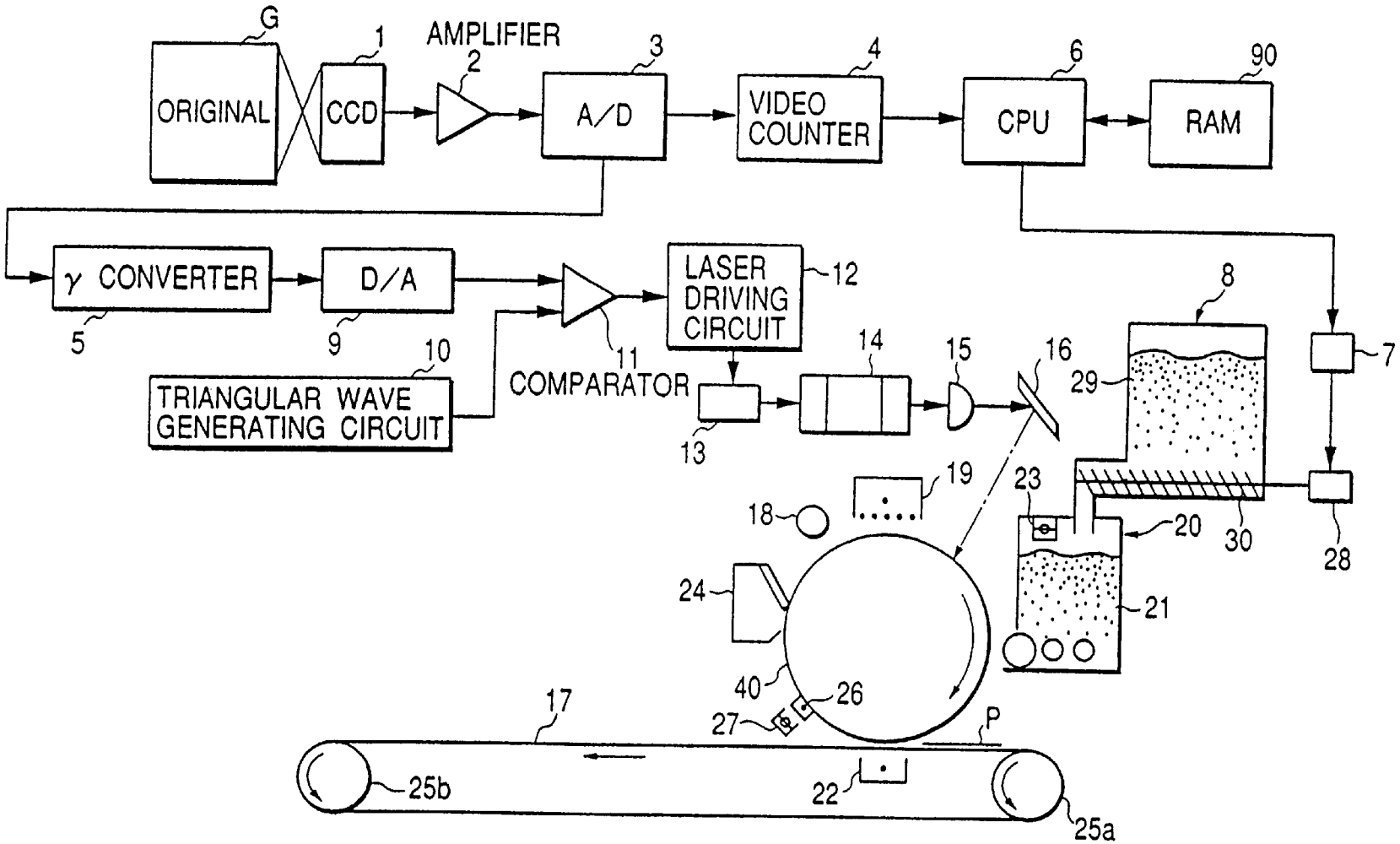
FIG. 7 PRIOR ART
FIG. 7 is a constructural view showing an example of a conventional image forming apparatus.

The detailed explanation is made with reference to a flowchart shown in FIG. 6. After copy start (step S20), it is judged whether or not a timing of patch detection ATR operation is a predetermined timing (step S21). If the predetermined timing, as mentioned above, it is judged whether or not (TC2–TC1) which is the difference value between the toner density TC1 in the developer obtained from the developer reflection ATR in the pre-copy operation and the target toner density TC2 is smaller than the predetermined value (1.5%) (step S22). If (TC2–TC1)<1.5%, the patch detection ATR is operated (step S23).

Then, the actual density of the patch image is compared with the initial density to calculate a toner replenishing amount D corresponding to image density difference (step S24), and the target value is altered by using βD (obtained by multiplying the given factor β by the toner replenishing amount D) as a correcting amount (step S25).

Then, the develop reflection ATR is operated to obtain the toner density of the developer 43 within the developing device 44 (step S26). And, the toner replenishing amount is calculated and determined on the basis of the difference value between the corrected target value (previous target value+βD) and the toner density of the developer 43 obtained by the developer reflection ATR (step S27), and the toner is replenished (step S28), and then the copying operation is ended (step S29).

Incidentally, in the step S21, if it is not the predetermined timing of the patch detection ATR, the previous target value is used, and the similar toner replenishing is effected. Further, in the step S22, if (TC2–TC1)≧1.5%, the previous target value is used without correcting the target value.

With the arrangement as mentioned above, since the control can be simplified and substantially the same effect as the first embodiment can be achieved, the toner density of the developer can be controlled to the density by which the proper image density of the toner image can be obtained, and a high quality image in which image density of the toner image is controlled properly can be formed.

Incidentally, in the above-mentioned embodiment, while the image forming apparatus comprising the plurality of latent image forming means for forming the electrostatic latent images on the plurality of image bearing members in a digital fashion, the plurality of developing means for developing the electrostatic latent images formed on the image bearing members by using the respective color two-component developers, and the plurality of toner replenishing means for replenishing the toners to the developing means was explained, the present invention can equally be applied to a system in which a single developing device is opposed to a single image bearing member or to a system in which a plurality of developing devices are opposed to a single image bearing member.

As apparent from the above-mentioned explanation, according to the image forming apparatus of the illustrated embodiment, by changing the correction amount as the control parameter of the toner density detecting means by means of the image density detecting means in accordance with the toner replenishing amount determined by the toner density detecting means, even if the toner density in the developing means is greatly deviated from the target value, the image density can be controlled stably and a high quality image can be obtained from the initiation of image formation.

Next, a second embodiment of the present invention will be explained. A hardware construction of an image forming apparatus according to the second embodiment is the same as that of the first embodiment.

Figure 8:
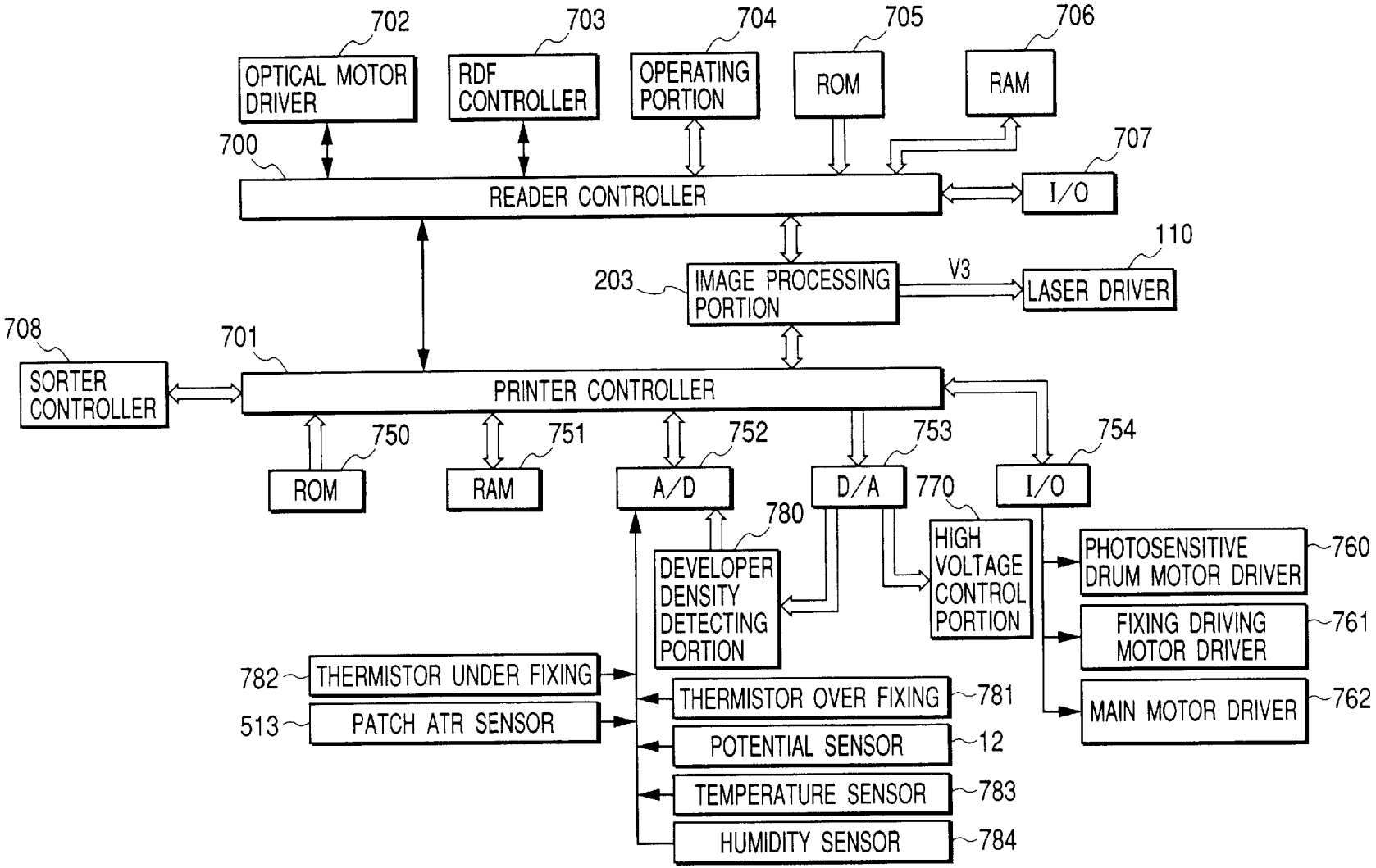
FIG. 8 is a block diagram showing a control system of an image forming apparatus.

FIG. 8 is a block diagram showing a control system of a color image forming apparatus according to the second embodiment.

The color image forming apparatus according to the second embodiment is generally divided into two blocks from the control viewpoint. One of the blocks is a reader controller for mainly effecting control of a reader portion and an image processing portion, and the other block is a printer controller for effecting control of a printer portion.

In FIG. 8, the image forming apparatus includes an optical driving motor driver 702 for driving an optical motor (not shown) for shifting a main scanning mirror and an exposure lamp, an RDF controller 703 for controlling an automatic original feeder (RDF) for automatically exchanging originals, an operating portion 704 for setting an operation mode of the color image forming apparatus, a ROM 705 for storing control program of a reader controller 700, a RAM 706 for storing data such as control values, and an I/O 707 for driving loads such as the exposure lamp 32.

Further, the RAM 706 is battery-backed up so that, even when the power is interrupted, the data can be reserved.

Next, peripheral control portions of the printer controller 701 will be explained.

In FIG. 8, there are provided a ROM 750 for storing control program of the printer controller 701, a RAM 751 for storing data such as control values, an A/D converter 752 for converting analogue signals from a potential sensor 12 and a patch ATR sensor 13 into digital data, a D/A converter 753 for outputting analogue signal setting values to a high voltage control portion 770, and an I/O 754 for driving the loads such as motors and clutches.

Next, toner density control within a developing device according to the illustrated embodiment will be described.

Figure 9:
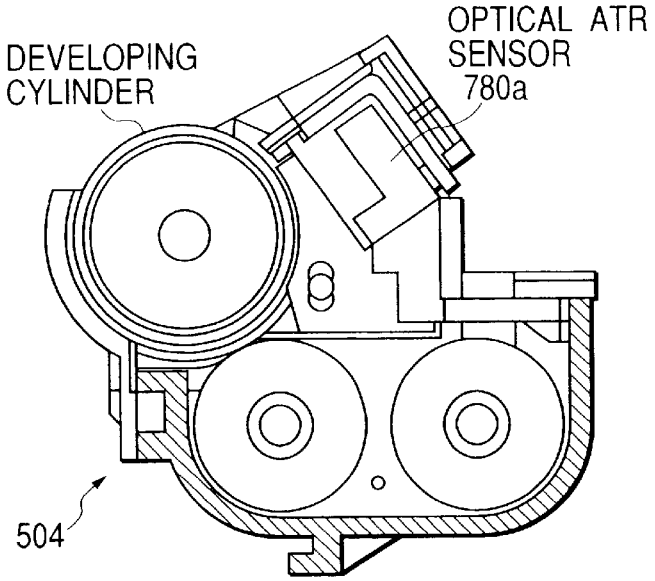
FIG. 9 is a schematic sectional view for explaining a developing apparatus included in the image forming apparatus.

As shown in FIG. 9, a developing device 504 comprises a developer container (not shown) containing developer including toner and carrier, an optical ATR sensor (first detecting means; developer density detecting means) 780*a* for detecting toner density of the developer within the developer container, and a hopper (toner replenishing means) (not shown) for replenishing the toner to the developer container.

Further, as shown in FIG. 8, the developing device 504 has a developer density detecting portion 780 connected to the printer controller 701, which developer density detecting portion serves to control the toner replenishing amount from the hopper to the developer container in such a manner that the toner density within the developer container becomes predetermined target toner density, on the basis of toner density detected by the optical ATR sensor 780*a* and a patch ATR sensor (second detecting means; image density detecting means) 513 for detecting the toner density of the toner image born on the photosensitive drum 40.

The developer density detecting portion 780 can correct the target toner density on the basis of the toner density detected by a light amount detecting sensor 513 on drum and serves to interrupt the correction of the target toner density based on the toner density detected by the patch ATR sensor 513 if the difference between the toner density detected by the optical ATR sensor 780*a* and the target toner density is equal to or greater than predetermined density and to effect toner density control only on the basis of the toner density detected by the optical ATR sensor 780*a*.

In the illustrated embodiment, a developing device 4Bk is subjected to control from the patch ATR method, and developing devices 4*m*, 4*c*, 4*y* are subjected to control from the combination of the optical ATR method and the patch ATR method.

Also in the illustrated embodiment, toners for the developing devices 4*m*, 4*c*, 4*y* (referred to as "M toner, C toner, Y toner" respectively hereinafter) each has a property that reflects near infrared light emitted from the LED, with carrier (iron powder) having a property that absorbs the near infrared light. That is to say, also in the illustrated embodiment, as the toner amount in the developer is decreased, since the a reflected amount of the near infrared light is decreased accordingly, in the optical ATR control, the toner replenishing amount can be determined on the basis of such difference. Further, whenever the predetermined number of image formations on the photosensitive drum 40 are completed, the patch developing is effected to detect the actual toner density, and such data is fed back to the ATR value, thereby effecting the correction.

On the other hand, unlike to the M toner, C toner and Y toner, since toner for the developing device 4Bk (referred to as "Bk toner" hereinafter) has a property that absorbs the near infrared light, even when the near infrared light is directly illuminated onto the toner, the toner amount in the developer cannot be detected. Thus, the toner density control for the Bk toner is effected only by using the patch ATR control method, rather than the optical ATR control method.

(ATR Photoelectric Detection Sensors)

Figure 10:
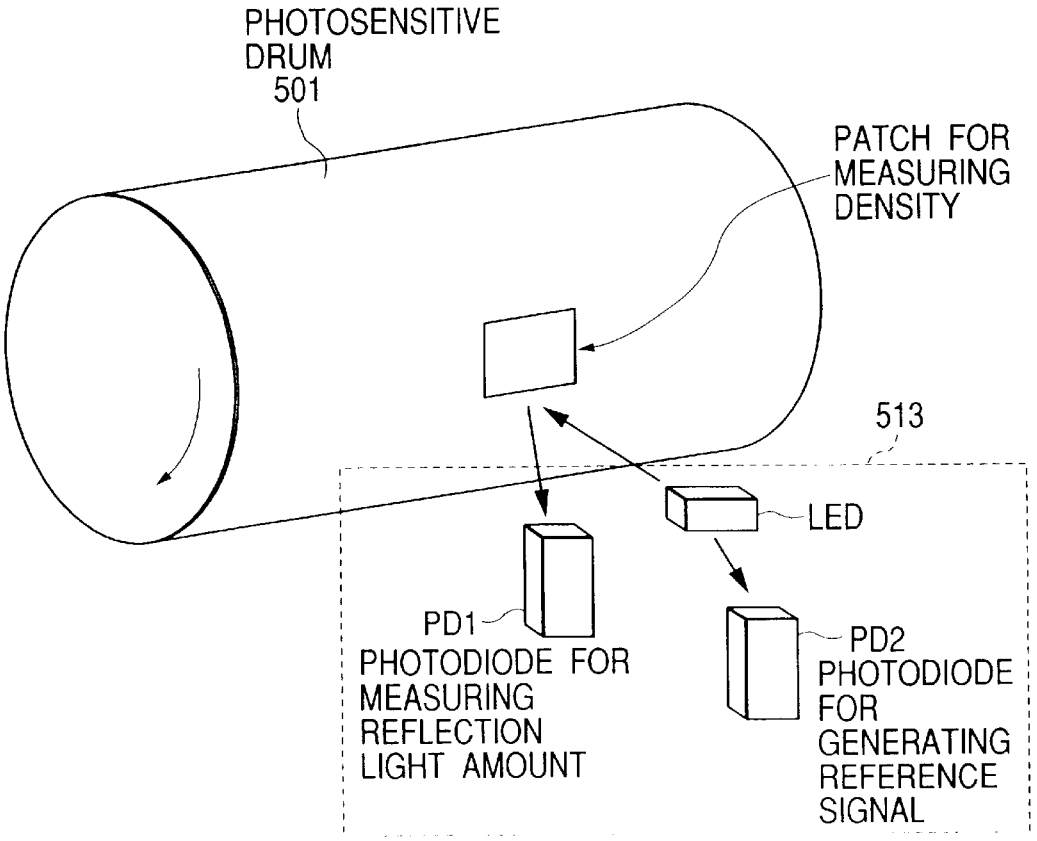
FIG. 10 is a schematic view of second detecting means according to a second embodiment of the present invention.
Figure 11:
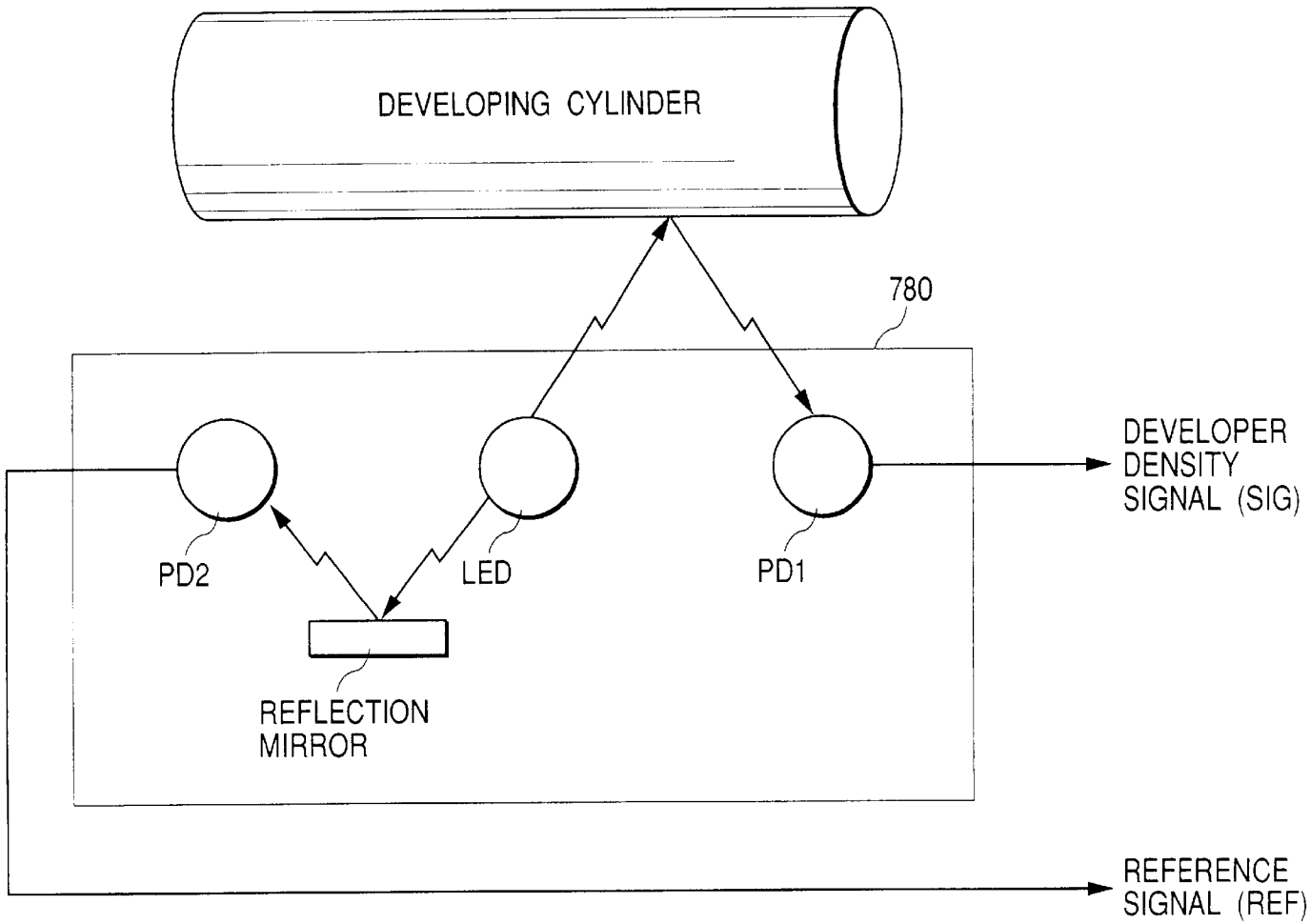
FIG. 11 is a schematic sectional view of first detecting means according to the second embodiment of the present invention.

FIGS. 9 to 11 show photoelectric detection sensors. FIG. 9 is a view for explaining an appearance of the developing device according to the illustrated embodiment, FIG. 10 is a view for explaining the patch ATR sensor (second detecting means) 513, and FIG. 11 is a view showing internal structure of the optical ATR sensor (first detecting means) 780*a* and for explaining the principle of the ATR.

As shown in FIG. 9, in the illustrated embodiment, the optical ATR sensor 780*a* is attached at a position opposed to a developing cylinder (developer bearing member).

The optical ATR sensor 780*a* is constituted by an LED, a photodiode PD2 for receiving direct light from the LED, and a photodiode PD1 for receiving light emitted from the LED and reflected by the developing cylinder, so that the direct light received by the photodiode PD2 is stored as a developer density signal.

Similarly, as shown in FIG. 10, the patch ATR sensor 513 according to the illustrated embodiment is designed so that light (near infrared light) emitted from an LED of the patch sensor is illuminated onto the patch image and non-developed area on a photosensitive drum (image bearing member) 501, and reflected light is received by a photodiode PD1. Further, in order to form a reference signal, direct light from the LED is received by a photodiode PD2.

In this way, in the illustrated embodiment, by using the developer density signal and the reference signal detected by the optical ATR sensor 780*a* and the patch ATR sensor 513, the toner amount to be replenished into the developing device 4 is calculated by a method which will be described later.

(Principle of ATR Control)

Next, a principle of the ATR control according to the illustrated embodiment will be explained.

Figure 12:
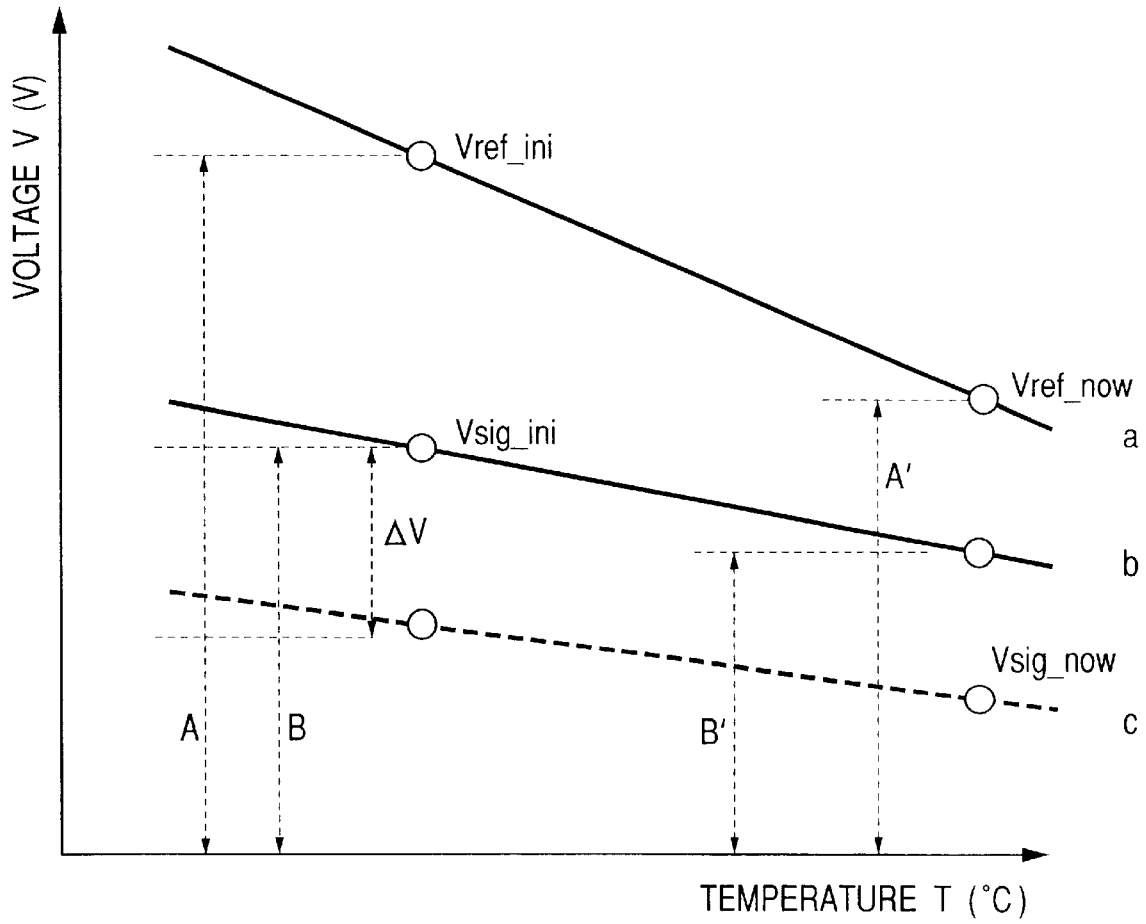
FIG. 12 is a view for explaining a principle of toner density detection of the first and second detecting means according to the second embodiment of the present invention.

FIG. 12 shows temperature property of reflected signals detected by the photoelectric optical ATR sensor and patch ATR sensor with reference to M toner, C toner and Y toner, and that of the reference signal.

First of all, upon initial adjustment of ATR, output values of the LED reflected light and direct light (reference light) are backed-up as Vsig_ini, Vref_mini, respectively. Upon the initial adjustment, T/C ratio of the developer mixing ratio of toner particles/carrier particles) is set to a correct value, and a temperature property of the reflected light at the correct T/C ratio corresponds to "b" in FIG. 12. Further, the temperature property "a" of the direct light has a linear relationship a=k'×b, so that a ratio k' (between a and b) is constant regardless of the temperature.

During the ATR control (i.e., upon replenishing toner), T/C ratio differs from that upon the initial adjustment, and the temperature property is changed to "c". Here, there is a linear relationship c=k'×a between "a" and "c", and a ratio k' (between a and c) is constant regardless of the temperature.

Further, a T/C ratio change value in the temperature conversion upon the ATR initial adjustment corresponds to ΔV. Accordingly, when it is assumed that the output values of the reflection light and the direct light upon toner replenishment are Vsig_now, Vref_now, respectively, since a/c=k'=constant, A/B becomes A'/B'.

Accordingly, Vref_ini/(Vsig_ini−ΔV)=Vref_now/Vsig_now is attained, and the following equation (1) can be obtained:

$$\Delta V = V\text{sig_ini} - V\text{ref_ini} \times (V\text{sig_now}/V\text{ref_now}) \quad (1)$$

Namely, the toner replenishing amount can be determined by using such ΔV on the basis of the difference between the reflection signal upon initial adjustment and the value obtained correcting the present (now) reflection signal, and the toner density of the developer can be kept constant by replenishing the determined amount of toner.

Regarding the Bk toner, since it has toner property opposite to those of the M toner, C toner and Y toner, the equation (1) is changed to:

$$\Delta V = V\text{ref_ini} \times (V\text{sig_now}/V\text{ref_now}) - V\text{sig_ini} \quad (2)$$

Incidentally, regarding the patch ATR, since a window of the patch sensor is contaminated by flying toner, it is necessary to effect window contamination correction in order to use the signal level as the proper value. When it is assumed that such a correction value is α (in order to identify the patch signal, "p_" is added), the following equation is obtained:

$$\Delta V = V\text{p_sig_ini} - V\text{p_ref_ini} \times (V\text{p_sig_now}/V\text{p_ref_now}) \times (1/\alpha) \quad (3)$$

In case of Bk toner, $$\Delta V = V\text{p_ref_ini} \times (V\text{p_sig_now}/V\text{p_ref_now}) \times (1/\alpha) - V\text{p_sig_ini} \quad (4)$$

is obtained.

Incidentally, by using the reflected light signal (D_SIG_INI) and direct light signal (=reference signal; D_REF_INI) of the photosensitive drum measured and stored upon initial setting or installation, and the present reflected light signal (D_SIG_NOW) and direct light signal (D_REF_NOW) of the photosensitive drum measured upon initiation of image formation, the calculation of the correction value α is calculated on the basis of the following equation (5), thereby correcting the signals of the sensors properly:

$$\text{correction value } \alpha=(D_SIG_INI/D_SIG_NOW)\times(D_REF_NOW/D_REF_INI) \quad (5)$$

Next, the actual toner density control will be described with reference to a flowchart shown in FIG. 13.

Figure 13:
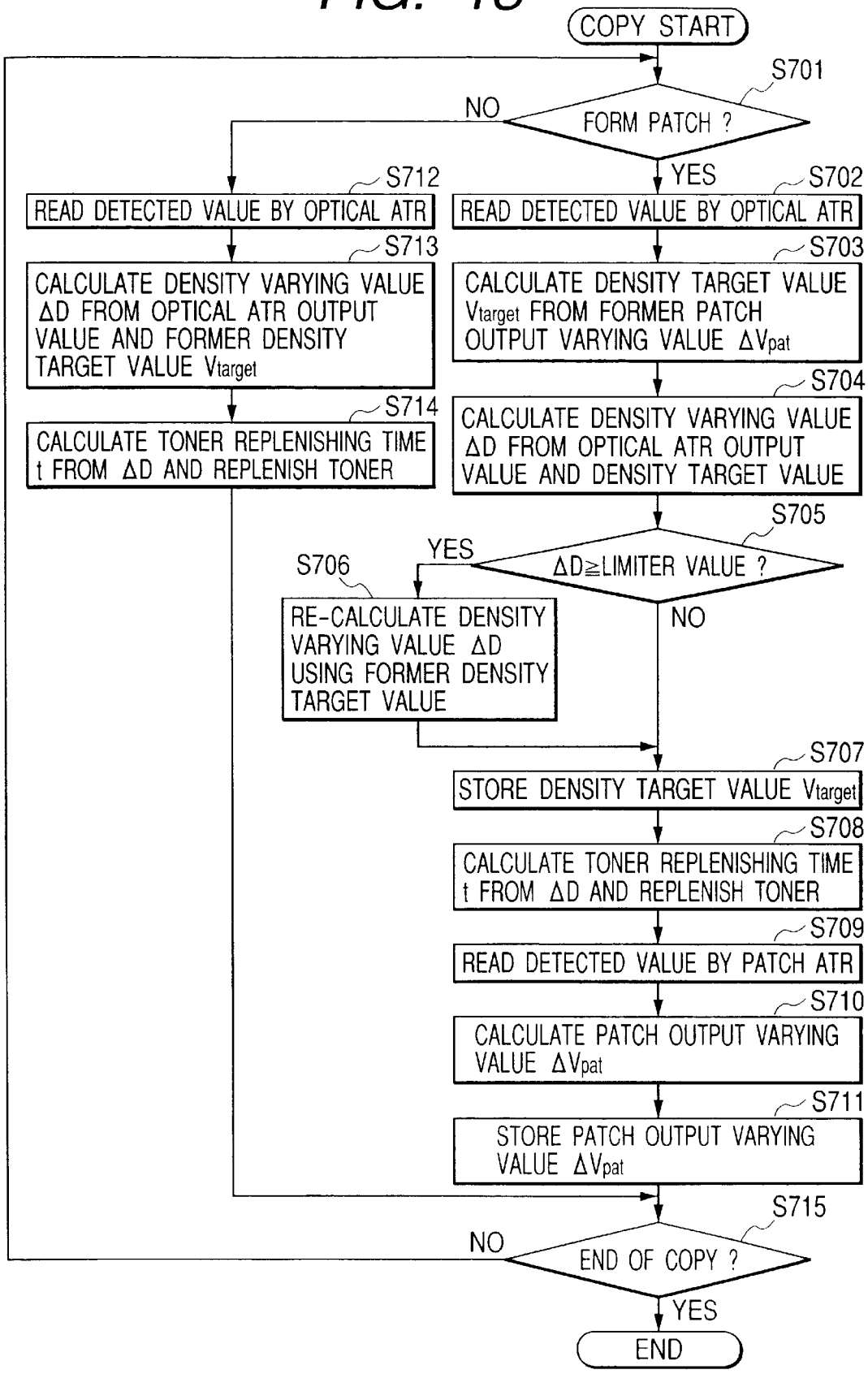
FIG. 13 is a flowchart for explaining toner supply control (toner density control) of a developing device according to the second embodiment of the present invention.

FIG. 13 is a flowchart for explaining ATR control for M toner, C toner and Y toner. As mentioned above, in the illustrated embodiment, the M toner, C toner and Y toner are subjected to the combination of the optical ATR control method and the patch ATR control method. In this combination, in order to reduce the varying in image density due to delay in response of the optical ATR during the initial several number of copies in the continuous copying operation, the replenishing is effected by changing the target value of the patch detection ATR.

Incidentally, regarding the Bk toner, since the control is effected only by using the patch ATR method, here, the combined ATR control will be explained, and explanation of the patch ATR control will be omitted.

In FIG. 13, after copy start, it is judged whether or not the patch is formed on the photosensitive drum 501 (step S701). The judgement of the patch formation is effected by counting "up" a patch forming counter whenever the image formation is performed and by judging whether or not the counter exceeds a predetermined value (a default value=20, in the illustrated embodiment). When the patch is formed, the counter is cleared, and, whenever the image formation is performed, the counter is made "up". Similar processing is repeated.

Accordingly, the patches are formed in substantially equal intervals.

When the patch is formed, after the detected value is read by the optical ATR sensor 780*a* (step S702), an optical ATR density target value Vtarget(n) is calculated by using the following recurrence formula (6), on the basis of the previously measured patch output varying value ΔVpat and the previously calculated optical ATR density target value Vtarget−(n1) (step S703):

$$V\text{target}(n)=V\text{target}(n-1)+\beta\Delta V\text{pat} \quad (6)$$

Incidentally, β in the equation (6) correction factor for effecting feedback correction for the patch output varying value (0.4 in the illustrated embodiment).

Further, when the patch is formed firstly after the initial setting of the ATR data, Vtarget(n) which is the first term in the equation (6) is Vtarget(n)=Vtarget(0)=Vsig_ini.

Then, from the optical ATR output value and the target density value Vtarget(n), the optical ATR output varying value ΔV given in the following equation (7) is sought, and, from ΔV, the (agent) density varying value ΔD (we%) is calculated as shown in the following equation (8) (step S704):

$$\Delta V=V\text{target}(n)-V\text{ref_ini}\times(V\text{sig_now}/V\text{ref_now}) \quad (7)$$

$$\Delta D=\Delta V/\gamma \quad (8)$$

Incidentally, γ is a value (constant) showing a relative relationship between the AD output value of sig/ref and the voltage output value.

Then, the calculated density varying value is compared with the density varying limit Dlim. If D≧Dlim, in place of Vtarget(n) calculated in the step S703, by replacing the previous value Vtarget(n−1) by Vtarget, the density varying value ΔD is calculated again on the basis of the above equations (7) and (8) (step S706). Thereafter, the density target value Vtarget(n) is stored in the back-up RAM (step S707).

On the basis of a toner replenishing table for seeking a replenishing ratio regulated by a sheet size, an image forming time t for sheet size to be actually subjected to image formation with the replenishing ratio is calculated from the calculated density varying value ΔD, and, by turning ON a connection clutch for opening a hopper replenishing opening for the time t, the toner is replenished from the hopper (toner replenishing means) (not shown) to the developing device (step S708).

Then, regarding the patch formed on the photosensitive drum 501, after the patch signal is read by the patch ATR sensor 513, the patch output varying value ΔVpat given by the above equation (3) is calculated (step S710). Similar to the density target value, the calculated value ΔVpat is stored in the back-up RAM (step S711).

The value ΔVpat is fed back and is used when the next optical ATR density target value Vtarget(n) is calculated in the step S703.

On the other hand, when the patch is not formed on the photosensitive drum 501, in a step S712, after the detection value is read by the optical ATR sensor 780*a*, on the basis of the previously calculated optical ATR density target value Vtarget(n) and the optical ATR output value, the optical ATR output varying value (ΔV) is sought and the density varying value ΔD is calculated (step S713).

Incidentally, although the optical ATR density target value Vtarget(n) is newly calculated and renewed when the patch is formed, when the patch is not formed, the previously (formerly) renewed value is used as it is and the calculation is not effected.

Then, in step S714, on the basis of the optical ATR output varying value ΔD calculated in the step S713, the toner replenishing amount to be actually replenished from the hopper (toner replenishing means) (not shown) to the developing device is calculated. The calculating procedure is the same as the process in the step S708 in the patch formation, and, by turning ON the connection clutch for the determined toner replenishing time t, the toner is replenished from the hopper to the developing device.

Lastly, it is judged whether the copy job is ended (step S715). If the copy job is continued, the program is returned to the step S701, and the steps S701 to S715 are repeated; whereas, if the copy job is finished, all of the processes are finished to end the copy.

Next, a third embodiment of the present invention will be explained. Incidentally since the mechanical construction of the third embodiment is the same as that of the second embodiment, the same elements as those in the second embodiment are designated by the same reference numerals and explanation thereof will be omitted.

In the second embodiment, in the step S706, the calculated density varying value ΔD is compared with the density varying limit Dlim, and, if D≧Dlim, in place of the calculated optical ATR density target value Vtarget(n), by replacing the previous value Vtarget(n−1) by Vtarget(n), the density varying value ΔD is calculated again. However, in the third embodiment, in place of the fact that the optical ATR density target value is corrected, the period between the patch formations is widened to prevent the density target level from being corrected excessively with respect to the present density level, thereby reducing the ripple of the density fluctuation.

Figure 14:
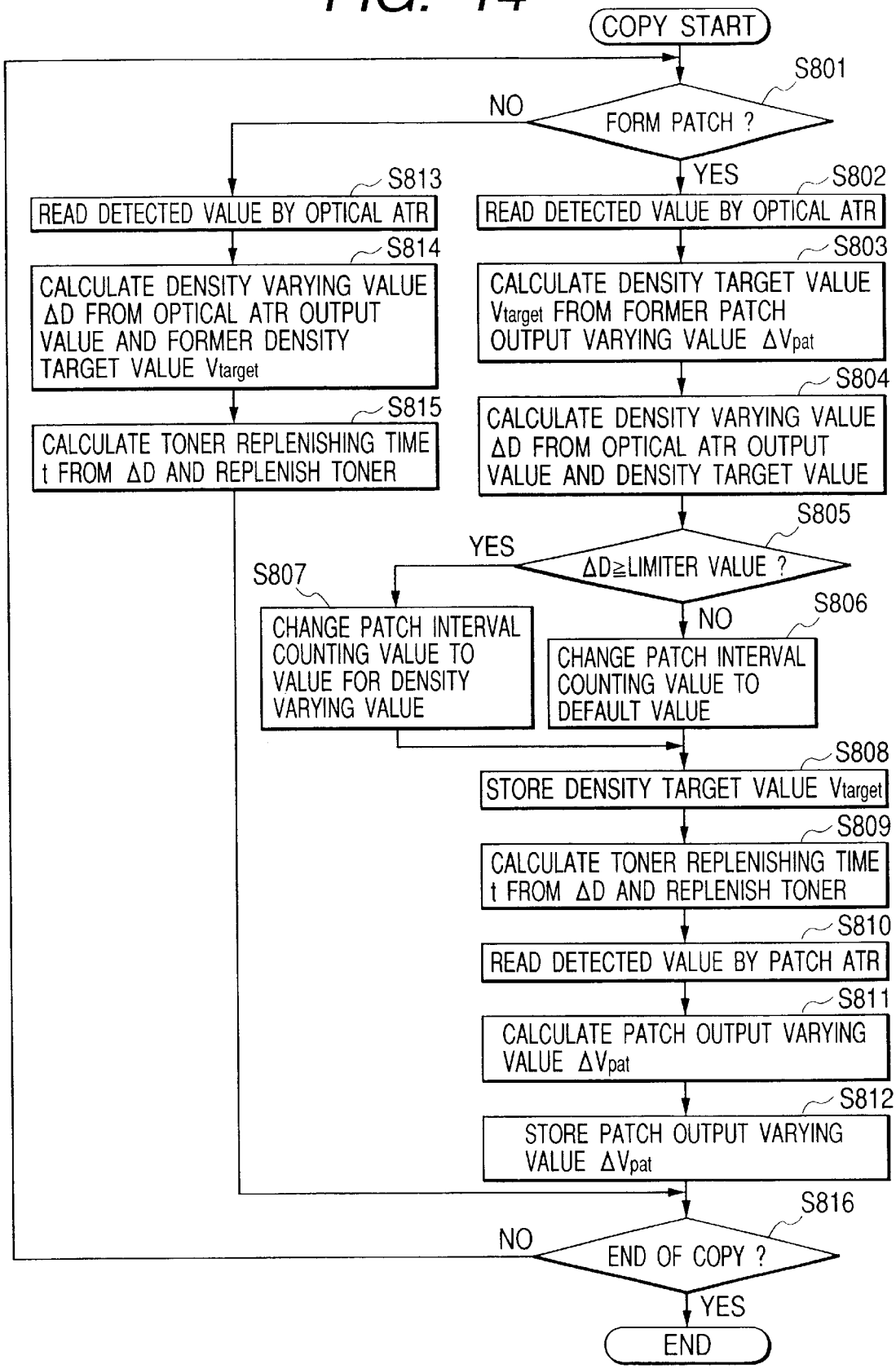
FIG. 14 is a flowchart for explaining toner supply control (toner density control) of the developing device according to the second embodiment of the present invention.

FIG. 14 is a flowchart for explaining ATR control for M toner, C toner and Y toner in the third embodiment.

In FIG. 14, when the copy job is started, it is judged whether or not the patch is formed on the photosensitive drum 501 (step S801). The judgement of the patch formation is effected by counting "up" a patch forming counter whenever the image formation is performed and by judging whether or not the counter exceeds a predetermined value P (patch interval counter value; a default value=20, in the illustrated embodiment).

When the patch is formed, the counter is cleared, and, whenever the image formation is performed, the counter is made "up". Similar processing is repeated. Accordingly, the patches are formed in substantially equal intervals.

When the patch is formed, after the detected value is read by the optical ATR sensor 780*a* (step S802), an optical ATR density target value Vtarget(n) is calculated by using the above recurrence formula (6), on the basis of the previously measured patch output varying value ΔVpat and the previously calculated optical ATR density target value Vtarget (n−1) (step S803).

Then, the optical ATR output varying value ΔV given in the above equation (7) is sought on the basis of the optical ATR output value and the target density value Vtarget, and, from the above equation (8), the (agent) density varying value ΔD (wt %) is calculated (step S804):

Then, in a step S805, the calculated density varying value ΔD is compared with the density varying limit Dlim (±2% in the illustrated embodiment). If D≧Dlim, the patch interval counter value P is changed from the default value (change from default value 20 to default value 40 in the illustrated embodiment) (step S807); whereas, if ΔD<Dlim, the patch interval counter value P is returned to the default value (step S806).

Incidentally, the density target value Vtarget(n) calculated in the step S803 is stored in the back-up RAM (step S808).

Then, on the basis of a toner replenishing table for seeking a replenishing ratio regulated by a sheet size, an image forming time t for sheet size to be actually subjected to image formation with the replenishing ratio is calculated from the density varying value ΔD calculated in the step S804, and, by turning ON a connection clutch for opening a hopper replenishing opening for the time t, the toner is replenished from the hopper to the developing device (step S809).

In a step S810, regarding the patch formed on the photosensitive drum 501, after the patch signal is read by the patch ATR sensor 513, the patch output varying value ΔVpat given by the above equation (3) is calculated (step S811).

Similar to the density target value, the calculated value ΔVpat is stored in the back-up RAM (step S812). The value ΔVpat is fed back and is used when the next optical ATR density target value Vtarget(n) is calculated in the step S803.

On the other hand, when the patch is not formed, in a step S813, after the detection value is read by the optical ATR sensor 780*a*, on the basis of the previously calculated optical ATR density target value Vtarget(n) and the optical ATR output value, the optical ATR output varying value (ΔV) is sought and the density varying value ΔD is calculated (step S814).

Incidentally, although the optical ATR density target value Vtarget(n) is newly calculated and renewed when the patch is formed, when the patch is not formed, the previously renewed value is used as it is and the calculation is not effected.

Then, in a step S815, on the basis of the optical ATR output varying value ΔD calculated in the step S814, the toner replenishing amount to be actually replenished from the hopper to the developing device is calculated. The calculating procedure is the same as the process in the step S809 in the patch formation, and, by turning ON the connection clutch for the determined toner replenishing time t, the toner is replenished from the hopper to the developing device.

Lastly, it is judged whether or not the copy job is ended (step S816). If the copy job is continued, the program is returned to the step S801, and the steps S801 to S816 are repeated; whereas, if the copy job is finished, all of the processes are finished to end the copy.

Incidentally, the present invention may be applied to a system constituted by a plurality of equipments (for example, a host computer, an interface equipment, a reader, a printer and the like) or a system comprised of a single equipment (for example, a copying machine, a facsimile apparatus or the like).

Further, it should be noted that the object of the present invention can be achieved by supplying a recording medium storing software program code for carrying out the function of the above-mentioned embodiments to a system or an apparatus and by executing the program code by a computer (or CPU or MPU) of the system or the apparatus for reading-out such program code.

In this case, when the program code itself read out from the recording medium performs the function of the above-mentioned embodiments, the recording medium storing such program code constitute a part of the present invention.

As a medium for supplying the program code, for example, a floppy disc, a hard disc, an optical disc, a photo-magnetic disc, a CD-ROM, a CD-R, a magnetic tape, a non-volatile memory card or a ROM can be used.

Further, by carrying out the program code read out by the computer, not only the function of the above-mentioned embodiments can be achieved, but also, on the basis of instruction of the program code, an OS (operation system) operating on the computer can effect the actual processing partially or entirely to achieve the function of the above-mentioned embodiments.

Further, after the program code read out from the recording medium is written in a memory included in a function expansion board inserted into the computer or in a function expansion unit connected to the computer, on the basis of instruction of the program code, a CPU included in the function expansion board or the function expansion unit can effect the actual processing partially or entirely to achieve the function of the above-mentioned embodiments.

When the present invention is applied to the recording medium, the program codes corresponding to the above-mentioned flowcharts are stored in the recording medium.

As mentioned above, in the combined control system including the optical ATR and the patch ATR, the target density value Vtarget in the optical ATR control is calculated, and the density varying value ΔD is sought on the basis of the target value and the optical ATR output value, and the replenishing amount of toner supplied from the hopper to the developing device is calculated on the basis of the density varying value ΔD. The target density value is controlled so that it is successively renewed by adding the patch output varying value ΔVpat calculated from the value read by the patch ATR sensor to the previous target density value.

However, when the calculated density varying value ΔD is great, if the target value is corrected on the basis of the patch output, the density target level may be corrected excessively with respect to the present density level, with the result that the difference between the present density level and the target level exceeds the allowable range to make the toner replenishing control unstable.

In the illustrated embodiment, when the calculated density varying value ΔD is great, since the density target value calculated and corrected on the basis of the patch output is not used but the previously calculated density target value is used to calculate the density varying value ΔD again, the density target level can be prevented from being corrected excessively with respect to the present density level, thereby reducing the ripple of the density varying.

Further, in this case, since the patch interval counter value is changed from the default value to widen the patch forming interval, response is prevented from becoming sensitive to the patch output varying value, thereby reducing the ripple of the density varying.

As mentioned above, according to the illustrated embodiments, in the combined ATRs, the target toner density is not corrected excessively in accordance with the toner density of the density detecting toner image on the latent image bearing member, and the ripple of the toner density varying within the developing device can be reduced.

What is claimed is:

1. A developer density controlling apparatus comprising:

first detecting means for detecting information corresponding to a density of a toner in a developer in a developer container;

second detecting means for detecting information corresponding to a density of a toner image; and control means for controlling a replenishing amount of the toner with which said developer container is replenished on the basis of an output of said first detecting means and a target value;

wherein said apparatus includes a first mode for changing the target value in accordance with the output of said first detecting means and an output of said second detecting means, and a second mode for not changing the target value in accordance with the output of said first detecting means and the output of said second detecting means, wherein a number of an image forming operations effected between a detecting operation and next detecting operation, which are effected by said second detecting means, is larger in the second mode than in the first mode.

2. A developer density controlling apparatus according to claim 1, wherein, in case of said first mode, said control means controls the replenishing amount of the toner by using the target value changed in accordance with the output of said first detecting means and the output of said second detecting means.

3. A developer density controlling apparatus according to claim 2, wherein said control means controls the replenishing amount of the toner on the basis of a difference between the output value of said first detecting means and the target value changed in accordance with the output of said second detecting means.

4. A developer density controlling apparatus according to any one of claims 1 to 3, wherein, in the case of said second mode, said control means controls the replenishing amount of the toner by using a last target value.

5. A developer density controlling apparatus according to claim 4, wherein said control means controls the replenishing amount of the toner on the basis of a difference between the output value of said first detecting means and the last target value.

6. A developer density controlling apparatus according to claim 1, wherein said first detecting means detects the information corresponding to a density of the developer by receiving a reflected light from the developer irradiated by a light.

7. A developer density controlling apparatus according to claim 1, wherein said second detecting means detects information corresponding to a density of a developer image for detection formed on an image bearing member.

8. A developer density controlling apparatus according to claim 7, wherein said second detecting means detects the information corresponding to the density of the developer image for detection by receiving a reflected light from the developer image for detection which is irradiated by a light.

9. A developer density controlling apparatus according to claim 1, wherein the developer includes a carrier.

10. An image forming apparatus comprising:

first detecting means for detecting information corresponding to a density of a toner in a developer in a developer container;

second detecting means for detecting information corresponding to a density of a toner image; and control means for controlling a replenishing amount of the toner with which said developer container is replenished on the basis of an output of said first detecting means and a target value;

wherein said apparatus includes a first mode for changing the target value in accordance with the output of said first detecting means and an output of said second detecting means, and a second mode not for changing the target value in accordance with the output of said first detecting means and the output of said second detecting means, wherein a number of an image forming operations effected between a detecting operation and next detecting operation, which are effected by said second detecting means, is larger in the second mode than in the first mode.

11. A developer density controlling apparatus according to claim 10, wherein, in the case of said first mode, said control means controls the replenishing amount of the toner by using the target value changed in accordance with the output of said first detecting means and the output of said second detecting means.

12. A developer density controlling apparatus according to claim 11, wherein said control means controls the replenishing amount of the toner on the basis of a difference between the output value of said first detecting means and the target value changed in accordance with the output of said second detecting means.

13. A developer density controlling apparatus according to any one of claims 10 to 12, wherein, in the case of said second mode, said control means controls the replenishing amount of the toner by using a last target value.

14. A developer density controlling apparatus according to claim 13, wherein said control means controls the replenishing amount of the toner on the basis of a difference between the output value of said first detecting means and the last target value.

15. A developer density controlling apparatus according to claim 10, wherein said first detecting means detects the information corresponding to a density of the developer by receiving a reflected light from the developer which is irradiated by a light.

16. A developer density controlling apparatus according to claim 10, wherein said second detecting means detects information corresponding to a density of a developer image for detection formed on an image bearing member.

17. A developer density controlling apparatus according to claim 16, wherein said second detecting means detects the information corresponding to the density of the developer image for detection by receiving a reflected light from the developer image for detection which is irradiated by a light.

18. A developer density controlling apparatus according to claim 10, wherein the developer includes a carrier.

19. A developer density controlling apparatus comprising:

first detecting means for detecting information corresponding to a density of a toner in a developer in a developer container;

second detecting means for detecting information corresponding to a density of a toner image;

control means for controlling an amount of the toner replenished to said developer container based on an output of said first detecting means and a target value;

change means for changing the target value in accordance with an output of said second detecting means; and determining means for determining whether the target value is changed by said change means in accordance with the output of said first detecting means, wherein a number of an image forming operations from when the target value is changed to when the target value is next changed is capable of being changed.

20. A developer density controlling apparatus according to claim 19, wherein said determining means does not change the target value if a difference between the output of said first detecting means and the target value is not less than a predetermined value.

21. A developer density controlling apparatus according to claim 20, wherein the amount of the toner replenished is controlled based on a difference between the output of said first detecting means and last target value.

22. A developer density controlling apparatus according to claim 19, wherein said determining means changes the target value if a difference between the output of said first detecting means and the target value is less than a predetermined value.

23. A developer density controlling apparatus according to claim 21, wherein said control means controls the amount of the toner replenished based on a difference between the output of said first detecting means and the target value after being changed by said change means.

24. A developer density controlling apparatus according to claim 19, wherein said first detecting means detects the information corresponding to the density of the developer by receiving a reflected light from the developer irradiated by a light.

25. A developer density controlling apparatus according to claim 19, wherein said second detecting means detects the information corresponding to the density of the developer image for detection, which is formed on an image bearing member.

26. A developer density controlling apparatus according to claim 25, wherein said second detecting means detects the information corresponding to the density of the developer image for detection by receiving a reflected light from the developer image for detection irradiated by a light.

27. A developer density controlling apparatus according to claim 19, wherein the developer includes a carrier.

* * * * *

UNITED STATES PATENT AND TRADEMARK OFFICE

CERTIFICATE OF CORRECTION

PATENT NO. : 6,442,355 B2
DATED : August 27, 2002
INVENTOR(S) : Kazuhiro Hasegawa et al.

It is certified that error appears in the above-identified patent and that said Letters Patent is hereby corrected as shown below:

Column 1,
Line 49, “(AID” should read -- (A/D --.

Column 2,
Line 47, “value” should read -- value, --; and “provided” should read -- is provided --.

Column 4,
Line 10, “do” should read -- does --;
Line 26, “do” should read -- does --;
Line 38, “views” should read -- views of --;
Line 55, “of” should read -- of the --;
Line 57, “of” should read -- of the --; and
Line 67, “invention;” should read -- invention; and --.

Column 5,
Line 64, “an” should read -- a --.

Column 6,
Line 6, “to” should read -- with --.

Column 11,
Line 4, “born” should read -- borne --; and
Line 27, “the a” should read -- a --.

Column 12,
Line 60, “(1/03))” should read -- (1/α) --; and
Line 65, “i(ni)” should read -- ini --.

Column 15,
Line 28, “S804):” should read -- S804). --.

Column 16,
Line 31, “constitute” should read -- constitutes --.

Column 17,
Line 34, “value;” should read -- value, --;
Line 41, “means,” should read -- means, and --; and
Line 42, “an” should be deleted.

UNITED STATES PATENT AND TRADEMARK OFFICE

CERTIFICATE OF CORRECTION

PATENT NO. : 6,442,355 B2
DATED : August 27, 2002
INVENTOR(S) : Kazuhiro Hasegawa et al.

It is certified that error appears in the above-identified patent and that said Letters Patent is hereby corrected as shown below:

Column 18,
Line 26, “value;” should read -- value, --;
Line 34, “means,” should read -- means, and --; and
Line 35, “an” should be deleted.

Column 19,
Line 25, “an” should be deleted.

Signed and Sealed this

Eighteenth Day of February, 2003

JAMES E. ROGAN
*Director of the United States Patent and Trademark Office*